US006173651B1

(12) United States Patent
Pathe et al.

(10) Patent No.: US 6,173,651 B1
(45) Date of Patent: Jan. 16, 2001

(54) METHOD OF DETONATOR CONTROL WITH ELECTRONIC IGNITION MODULE, CODED BLAST CONTROLLING UNIT AND IGNITION MODULE FOR ITS IMPLEMENTATION

(75) Inventors: Claude Pathe, Hery; Raphael Trousselle, Auxerre, both of (FR); Philippe Clot, Les Charbonnieres (CH); Eric Fivaz, Les Hopitaux Neufs (FR)

(73) Assignee: Davey Bickford, Rouen Cedex (FR)

( * ) Notice: Under 35 U.S.C. 154(b), the term of this patent shall be extended for 0 days.

(21) Appl. No.: 09/194,322

(22) PCT Filed: May 21, 1997

(86) PCT No.: PCT/FR97/00891

§ 371 Date: Jan. 19, 1999

§ 102(e) Date: Jan. 19, 1999

(87) PCT Pub. No.: WO97/45696

PCT Pub. Date: Dec. 4, 1997

(30) Foreign Application Priority Data

May 24, 1996 (FR) ..... 96 06509

(51) Int. Cl.[7] ..... F42B 3/16

(52) U.S. Cl. ..... 102/218; 102/206; 102/215; 102/200

(58) Field of Search ..... 102/206, 200, 102/215, 218

(56) References Cited

U.S. PATENT DOCUMENTS

| | | | | |
|---|---|---|---|---|
| 4,632,032 | * | 12/1986 | Muller | 102/206 |
| 4,674,047 | * | 6/1987 | Tyler et al. | 364/423 |
| 4,712,477 | * | 12/1987 | Aikou et al. | 102/206 |
| 4,986,183 | * | 1/1991 | Jacob et al. | 102/200 |
| 5,117,756 | * | 6/1992 | Goffin, II. | 102/217 |
| 5,214,236 | * | 5/1993 | Murphy et al. | 102/217 |
| 5,295,438 | * | 3/1994 | Hill et al. | 102/217 |
| 5,460,093 | | 10/1995 | Prinz et al. . | |
| 5,520,114 | * | 5/1996 | Guimard et al. | 102/215 |

FOREIGN PATENT DOCUMENTS

| | | |
|---|---|---|
| 0 433 697 | 6/1991 | (EP) . |
| WO 87/00265 | 1/1987 | (WO) . |

* cited by examiner

*Primary Examiner*—Charles T. Jordan
*Assistant Examiner*—Lulit Semunegus
(74) *Attorney, Agent, or Firm*—Young & Thompson

(57) ABSTRACT

A control method for detonators (1) fitted with an electronic ignition module (15). Each module (15) is associated with specific parameters including at least one identification parameter and one explosion delay time, and includes a firing capacitor and a rudimentary internal clock. The modules (15) are capable of establishing a dialogue with a firing control unit (17) fitted with a reference time basis. The identification parameters are stored in the modules using a programming unit (18); the specific parameters are stored in the firing control unit (17); for each successive module, its internal clock is calibrated using the firing control unit and the associated delay time is sent to the module; the modules are ordered to load the firing capacitors; and a firing order is sent to the modules using the firing control unit, triggering off eventual resetting of the internal clocks as well as a firing sequence.

11 Claims, 6 Drawing Sheets

METHOD OF DETONATOR CONTROL WITH ELECTRONIC IGNITION MODULE, CODED BLAST CONTROLLING UNIT AND IGNITION MODULE FOR ITS IMPLEMENTATION

BACKGROUND OF THE INVENTION

This invention relates to a detonator control method of the electronic ignition module type, as well as to an encoded firing control assembly and to a ignition module for its implementation.

In most works involving explosives, the bursters containing the detonators are caused to detonate according to a very accurate time sequence, in order to improve the working yield of the explosive and to better control its effects.

Conventionally, a pyrotechnic device at the level of the detonators themselves enables to obtain various delay times between the explosions of the bursters. The detonators are actuated simultaneously by an exploder which delivers a certain electric energy to a firing line linking the detonators, in series or in parallel. The combustion of retarding pyrotechnic compounds then generates the requested pyrotechnic delays.

However, these pyrotechnic delays often exhibit insufficient relative accuracy.

To overcome this shortcoming, it has been suggested to use integral delay detonator ignition devices of the electronic type. Such devices enable to take advantage of the accuracy of electronic systems to enrich and to fine-tune the delay time ranges obtained previously in a pyrotechnic manner.

The application for patent FR-2.695.719 suggests a detonator control method with an integral delay electronic ignition module in which the ignition modules can be programmed using a programming unit. They call for an accurate time basis at the level of each detonator.

It has also been suggested in the patent U.S. Pat. No. 4,674,047, to use detonators fitted with electronic means enabling them to establish a dialogue with an external control unit. Each detonator is fitted with a capacitor whose discharge actuates the burster. The delay times of each detonator can be programmed on-site, whereas an identification code has been ascribed previously to each detonator, for example when leaving the factory. During a firing sequence, the detonators receive from the control unit successive orders, first to discharge the capacitor above mentioned, then to fire. They send back to the control unit, pieces of information enabling this unit to check the firing sequence for correct operation. The detonators are fitted to this view with a microprocessor-based local intelligence. The delay times which have been ascribed to the said are stored on non-volatile memories in their microprocessors.

In this last known system, each of the detonators has an internal time basis enabling it to perform a countdown in relation to the delay time which it has been ascribed. At the time of programming the detonator, its time basis is compared to a reference time basis for the control unit. Any possible error is then compensated for by a delay time adjusted value, whereby this adjusted value is stored in a memory of the detonator.

SUMMARY OF THE INVENTION

The purpose of this invention is to provide a control method of the electronic ignition module type, as well as an encoded firing control assembly and a ignition module for its implementation, conferring to the detonators the advantages above mentioned of the integral electronic delay detonators, but also greater simplicity of manufacture and of operation, as well as increased safety.

More precisely, a purpose of the invention is to be able to use detonators having rudimentary internal clocks while enabling excellent accuracy of a firing sequence.

Another purpose of the invention lies in using as internal clocks, cheap and heavy-duty oscillators, incorporated into integrated circuits.

According to the invention, a detonator control method of the electronic ignition module type is provided, whereby each ignition module is associated with specific parameters comprising at least one identification parameter and one explosion delay time of the associated detonator. The ignition module comprises:

- a firing capacitor designed, after loading, to discharge in a cartridge head of the detonator to generate an ignition,
- a battery capacitor ensuring temporary operating autonomy,
- a rudimentary internal clock with a local frequency,
- a non-volatile identification memory designed for the storage of the identification parameters.

The modules are capable of establishing a dialogue with a firing control unit fitted with a reference time basis and designed for transmitting to them an order to load their firing capacitors, as well as an order to fire and to receive from the modules one or several pieces of information relevant to their states.

According to the method:

- the specific parameters are stored in at least one information storage medium,
- at least one programming unit is caused to enter the identification parameters,
- using the programming unit, the identification parameters are stored in the modules,
- the specific parameters are stored using the information storage medium in the firing control unit,
- the modules are ordered using the firing control unit, to load the firing capacitors,
- a firing order is sent to the modules using the firing control unit, triggering off a firing sequence synchronised to the local frequencies.

The control method according to the invention is characterised in that after storing the specific parameters in the firing control unit and before loading the firing capacitors, the local frequency of the internal clock of the module is measured, using the firing control unit and for each successive module, using the reference time basis, then this internal clock is calibrated taking this measurement into account, using an algorithmic correction value of the local frequency and finally, an associated delay time is sent to the module.

The word <<calibration>> must be here understood as the determination of the algorithmic correction value appropriate for each module, since we want to stress that we are not acting on the internal clock properly speaking and hence, we do not modify its local frequency.

The factory adjustable internal clocks are calibrated shortly before a firing sequence.

This calibration is the all the more important that the local frequencies of the modules are, at first, all distinct from one another and therefore lead to an algorithmic correction value which is different for each module.

The control method according to the invention can be singled out from the previous art by the roles played by the programming unit, the firing control unit and the information storage medium. It is particularly unique in that the internal clocks of the modules are first adjusted during manufacture, then calibrated shortly before a firing sequence, using the reference time basis of the firing control unit. The calibration stage of the internal clocks is dissociated from the programming of the delay times of the modules.

An obvious advantage of the method according to the invention lies in that it is now possible to use in the modules, rudimentary adjustable internal clocks, whereas solely the reference time basis contained in the firing control unit should be accurate. Such an internal clock may for instance be incorporated into an integrated circuit, such a usually denominated ASIC (Application Specific Integrated Circuit). To serve as a clock, a simple circuit comprising a resistor and a capacitor is thus perfectly suited, although a frequency recorded in this circuit is subject to noticeable alteration with the passing of time. It is however quite interesting to use internal clocks which are rather stable in the long run, in order to avoid any final resetting stage. The solution suggested in the method according to the invention reduces notably the cost of the circuit in relation to the use of a quartz, without detriment to the accuracy nor to the safety of a firing sequence.

Another advantage provided by the use of rudimentary oscillators lies in that they may be more vibration-proof and hence less fragile, than a quartz.

Identification parameters can be entered in two ways into the programming unit: either by inputting them manually or by letting the programming unit calculate them automatically following an incrementing process.

According to an advantageous embodiment, after the firing order, the internal clocks of all the modules are reset. The internal clocks are thus reset just before a firing sequence.

This implementation method is necessary when the internal clocks exhibit frequencies liable to significant deviations with the passing of time. Conversely, if they are stable enough, it proves optional, if not superfluous.

According to a first preferred embodiment of the control method according to the invention, during the calibration of the internal clock of each module, a corrected delay time is calculated using the firing control unit, whereby this delay time is sent to the module.

According to a second preferred embodiment of the control method according to the invention, each module comprising a processing unit, when calibrating the internal clock of this module, the algorithmic correction value of the local frequency of its internal clock is sent to the module using the firing control unit, then a corrected delay time is calculated using the processing unit of the module.

The information storage medium is advantageously distinct from the programming unit.

Thus, prior recording of the firing data is possible. However, the information storage medium can this be identified at the level of the programming unit.

Several tests ought to be carried out during the control process according to the invention.

Thus, after storing the specific parameters in the firing control unit and before measuring the local frequencies, the modules are tested preferably using the firing control unit, while asking them at least one piece of information and by addressing each module individually by its identification parameters in order to collect the said information.

Moreover, before storing the identification parameters, in each module, the electronic and pyrotechnic functionalities, preferably, of the related detonator are tested.

An additional test is advantageously performed further to sending to the modules a firing order, before resetting their internal clocks: each module then sends back to the firing control unit, a confirmation signal of its being ready for firing.

According to the invention, an encoded firing control assembly comprising detonators with electronic ignition module is provided, whereas each ignition module is associated with the specific parameters comprising at least one identification parameter and an explosion delay time of the corresponding detonator during a firing sequence, whereas this ignition module comprises the following:

- a firing capacitor designed, after loading, to discharge in a cartridge head of the detonator to generate an ignition,
- a battery capacitor ensuring temporary operating autonomy,
- a rudimentary internal clock with a local frequency,
- a non-volatile identification memory designed for the storage of the identification parameters.

The encoded assembly also comprises:

- a programming unit capable of inputting the specific parameters of the modules and of storing the identification parameters in the corresponding modules,
- a firing control unit fitted with a reference time base and with a memory capable of receiving the specific parameters of the modules, whereas this firing control unit can be linked electrically on line with the modules and to establish a dialogue with them, especially by sending to the modules having received their identification parameters from the programming unit, the associated delay times, while measuring the local frequencies of their internal clocks using the reference delay time, by calibrating these internal clocks and by sending to the modules a firing order triggering off a firing sequence.

According to the invention, the firing control unit and the modules comprise calibration means enabling to calibrate the internal clocks in relation to the reference time basis after storing specific parameters in the firing control unit.

According to an advantageous embodiment, the modules comprise means for resetting their internal clocks further to a firing order sent by the firing control unit.

The encoded assembly comprising an electric link between each module and the cartridge head of the associated detonator, and this module being capable of sending to this cartridge head, via the electric link, a current generating a firing sequence, the cartridge heads should possess conducting or semiconducting bridges.

The invention also relates to a detonator ignition module with pyrotechnic burster comprising a supply circuit containing notably a battery capacitor ensuring temporary operating autonomy, a communications interface, a pyrotechnic burster management circuit comprising, notably a firing capacitor designed for, after loading, discharging into a cartridge. head of the detonator, as well as a logic unit for the management of the module assembly. This logic unit comprises a non-volatile identification memory designed for receiving at least one non-volatile identification parameter of the module and a rudimentary internal clock with a local frequency.

The ignition module according to the invention is specific in that it contains a calibration memory enabling to receive a calibration value of the internal clock in relation to a reference time basis, originating from a firing control unit capable of sending to the module, a firing order.

According to an advantageous embodiment, the module according to the invention comprises means for resetting the internal clock to a calibrated state and the logic unit comprises a resetting control actuating the resetting means during a firing order.

According to a preferred embodiment of the ignition module according to the invention, it comprises a customised ASIC-type integrated circuit, the firing capacitor, the battery capacitor, a power transformer and a protective device against electrostatic discharges.

This protective device is advantageously constituted of an element denominated Transil.

The ASIC circuits enable at the same time miniaturisation and low power consumption.

This invention will now be illustrated without being limited by embodiments, while referring to the appended drawings, on which:

DESCRIPTION OF THE PREFERRED EMBODIMENTS

Figure 1:
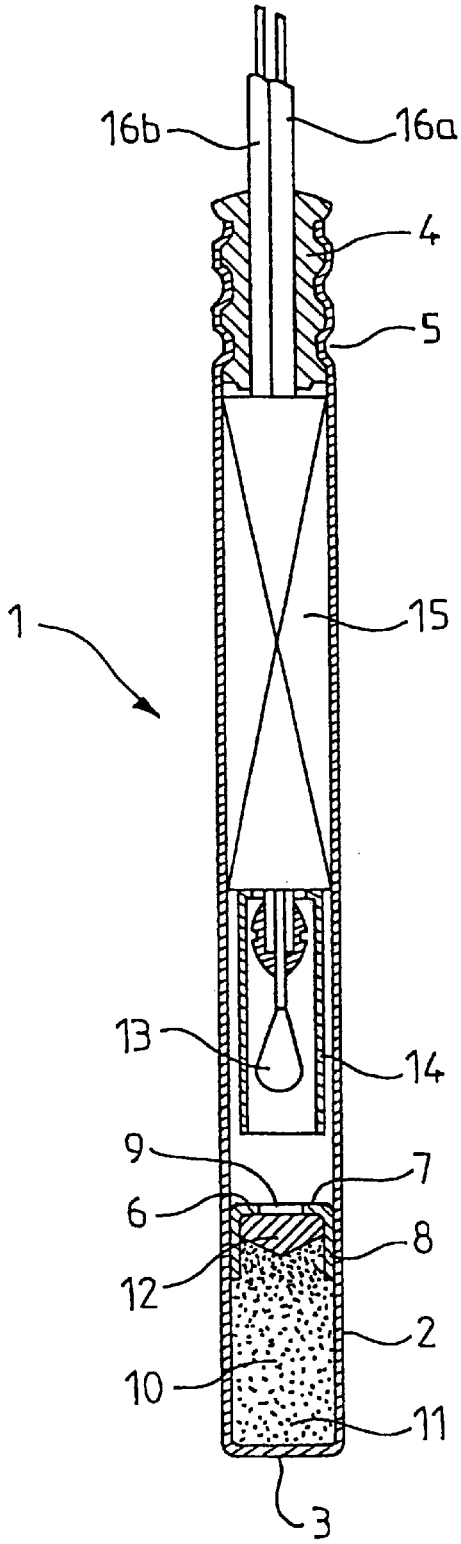
FIG. 1 is a diagrammatic representation of a detonator fitted with an integral electronic delay ignition module complying with an embodiment and an implementation mode of the invention.

The detonator I with the electronic ignition module described, represented on FIG. 1, comprises a sleeve 2 acting as a casing and whose body is cylindrical and oblong in shape, terminated at one of its ends by a bottom 3. At its other end, this sleeve 2 is blanked off by a plug also oblong 4, whereas the walls of the sleeve 2 are interconnected to the plug 4 via a crimped section 5. The sleeve 2 is made of an aluminium alloy, whereas the plug 4 is of standard PVC.

The end 3 of the sleeve 2 is associated with a frangible disc 6 in aluminium comprising a bottom 7 arranged according to a straight section of the sleeve 2 and surrounded by a cylindrical skirt 8 extending from the bottom 7 of the frangible disc 6 towards the bottom 3 of the sleeve 2. The external walls of the skirt 8 hug more or less the internal walls of the sleeve 2. The bottom 7 of this frangible disc 6 is traversed in its thickness by a bore 9 whose rim is a circle centred on the axis of the sleeve 2. This frangible disc 6 delineates with the bottom 3 and the walls of the body of the sleeve 2 a chamber 10 containing, in its inside section, a burster 11 such as pentrite, whereby this burster 11 is added a detonating compound 12 arranged in the chamber 10 at the level of the frangible disc 6. The proportions of pentrite and of detonating compound are respectively 0.6 g and 0.2 g.

On the frangible disc side 6, opposite the chamber 10, is arranged a cartridge head 13 extending axially in the sleeve 2 and protected by a cylindrical shroud 14. This cartridge head 13 is connected directly to an electronic ignition module 15 arranged in the sleeve 2 between the shroud 14 and the plug 4. This electronic module 15 is supplied at its end, at the level of the plug 4, by two sheathed wires 16*a* and 16*b* going through the plug 4 in its height and connect the module 15 to an ignition circuit (not represented).

Advantageously, the cartridge head of the embodiment, represented on FIG. 1, can be replaced with a cartridge head comprising a conducting or semiconducting bridge.

A current flowing through the cartridge head 13, whose intensity lies above an operating threshold, initiates the cartridge head 13 and drives the burster 12 through the opening 9 through the frangible disc 6. This drive triggers the detonation.

A firing assembly can be constituted of detonators 1 identical to that represented previously. This firing assembly, visible on FIGS. 2B and 2C, may comprise any number of detonators 1, whose ignition modules 15 are mounted on line according to a network parallel to a firing control unit 17, also denominated <<firing console>>.

Preferably, the detonators 1 and their ignition modules 15 are all identical from the viewpoint of manufacture and are all encoded. They are rendered individual with respect to one another only on-site during the programming phase. The construction of the firing assembly is thus facilitated.

The ignition modules 15 are non-polarised. They can be used in a large number in a parallel lay-out, up to 200 and more, without causing problems which could be ascribed to an excessive line current.

The modules 15 are capable of communicating with the firing console 17, which can transmit orders to them and receive information from them.

The firing assembly also comprises a programming unit 18, also called <<programming console>>. The latter is designed for programming each module 15 before or after being placed in a hole. It can also be used to transfer information on firing sequences in the firing console 17.

Three configurations can be contemplated for the connections between detonators 1, firing console 17 and programming console 18.

Figure 2A:
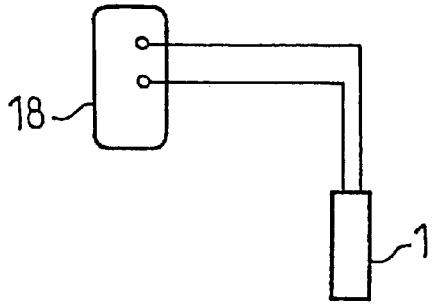
FIGS. 2A, 2B and 2C are diagrammatic representations of a firing assembly comprising detonators mounted in parallel, of the type of that represented on FIG. 1, underlining communications circuits established respectively when programming a detonator, when transferring information from the programming unit to the firing control unit and during a firing sequence of a detonator burst.

In a first configuration, represented on FIG. 2A, the programming console 18 is connected successively to each detonator 1. This first configuration corresponds to a first stage, during which the modules 15 are programmed by the programming console 18.

Figure 2B:
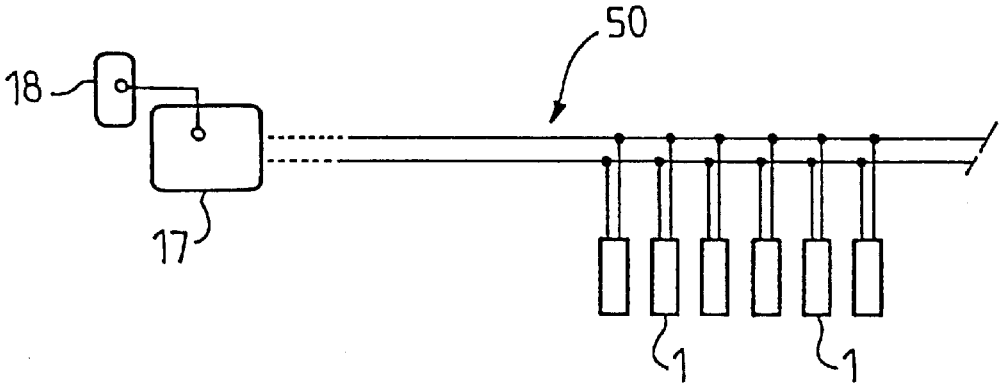

In a second configuration, represented on FIG. 2B, the programming console 18 is connected to the firing console 17 while the link between the detonators 1 and the firing console 17 is disabled.

This second configuration corresponds to a second stage, during which pieces of information relating to the detonators I are transferred from the programming console 18 to the firing console 17, information that can be used later for one or several firing sequences.

Figure 2C:
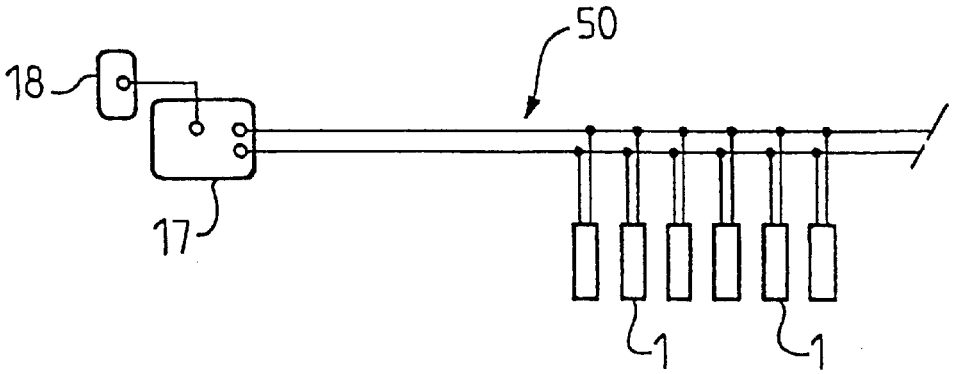

In the third configuration, represented on FIG. 2C, the programming console 18 and the detonators 1 are connected to the firing console 17, whereas the modules 15 of the detonators 1 are connected to the firing console 17 by a firing line 50. This third configuration corresponds to a third stage, during which the firing console 17 is liable to communicate with the modules 15, then at a later stage, during which the firing console 17 can manage a firing procedure and fire the detonators I connected to the firing line 50.

The firing console 17 and the ignition modules 15 exchange information via encoded binary messages. As the firing line 50 is a two-wire one, the firing console 17 and the ignition modules 15 must be tolerant to degradations to which electric signals may be subject during their transit over this line 50. The messages transmitted to the modules are encoded in the form of four-bit words.

The firing console 17 also serves to supply the ignition modules 15. This power supply constitutes the energy source liable to trigger firing. That way, the ignition modules 15 do not exhibit any risks of untimely triggering outside the firing sequences.

The firing 17 and programming 18 consoles have similar structures and differ mainly by their functionalities and hence by the management software with which they are associated.

Each console comprises:

- a microprocessor-based logic unit, for instance of the type marketed by MOTOROLA under the denomination 68 HC 11 and which integrates 512 bytes of EEPROM memory enabling to store certain operating parameters in a non-volatile manner, a RAM, an input and output network, an RS 232 type communications interface to enable the firing 17 and programming 18 consoles to communicate,
- a luminescent liquid crystal display,
- a power supply providing ±5 Volts to the logic unit and ±18 Volts to the line interface, whereas the upstream voltage amounts to 18 Volts,
- a line interface composed of two sub-systems, whose a transmission portion, which is a regulated power supply liable to switch to deliver +12 or +6 Volts, and a reception portion which measures the current drawn on the line and which detects transitory overconsumptions of the ignition modules 15,
- a reference time basis, comprising typically a quartz to drive it.

Each ignition module 15 is associated with three specific parameters. Two of these specific parameters are identification parameters of the module 15. Several firing sequences taking place in succession and each involving a number of detonators 1, both these identification parameters comprise a firing board number representative of the related firing sequence, and an order number designating the module 15 within the framework of this sequence. The third specific parameter is an explosion delay time of the detonator 1 corresponding to the module 15 during the firing sequence.

The modules 15 are liable to receive two types of message: a command, or a storable piece of information, whereby the said piece of information can consist especially of one of the specific parameters of the module 15. Any reception of a storable piece of information is preceded by the reception of an appropriate command, so that the ignition module knows systematically the type of information which is going to be sent to the former.

The firing console 17 comprises four keys which can be actuated by a user to initiate four functions respectively. These four keys trigger respectively the following: testing the ignition modules 15, activating the detonators 1, a firing sequence and cancelling the firing sequence. A fifth function of the firing console 17, automatically actuated consists of an automatic transfer of data to the firing console 17, from the programming console 18 or an internal or external information storage medium. Two lights, a green and a red one, have also been designed to act as indicators when testing the modules 15. The green light is designed for coming on in normal condition and the red one in case of problems.

The firing console 17 is advantageously fitted with a magnetic card authorising its use.

The programming console 18 comprises a keyboard of 12 alphanumeric keys, enabling especially to input the specific parameters of the modules 15. It also comprises a push-button enabling to toggle between two programming procedures. In the first of those procedures, so-called manual procedure, the operator programs the delay times directly on his keyboard, while in the second procedure, so-called automatic procedure, these times are stored separately on the information storage medium, which is internal or external to the firing console 17.

The programming console 18 fulfils six functions. The first of those functions consists in programming or reprogramming one of those ignition modules 15, by recording those identification parameters and possibly its delay time, in the memory of this module 15. A second function of the programming console 18 is the storage of the specific parameters in its own memory. A third function consists in testing any of the ignition modules 15. A fourth function consists is wiping off the screen of the programming console 18. A fifth function consists in reading the content of the memory of any ignition modules 15 thus programmed. The sixth function is constituted of a transfer to the firing console 17 of all the specific parameters recorded in the modules 15.

Figure 3:
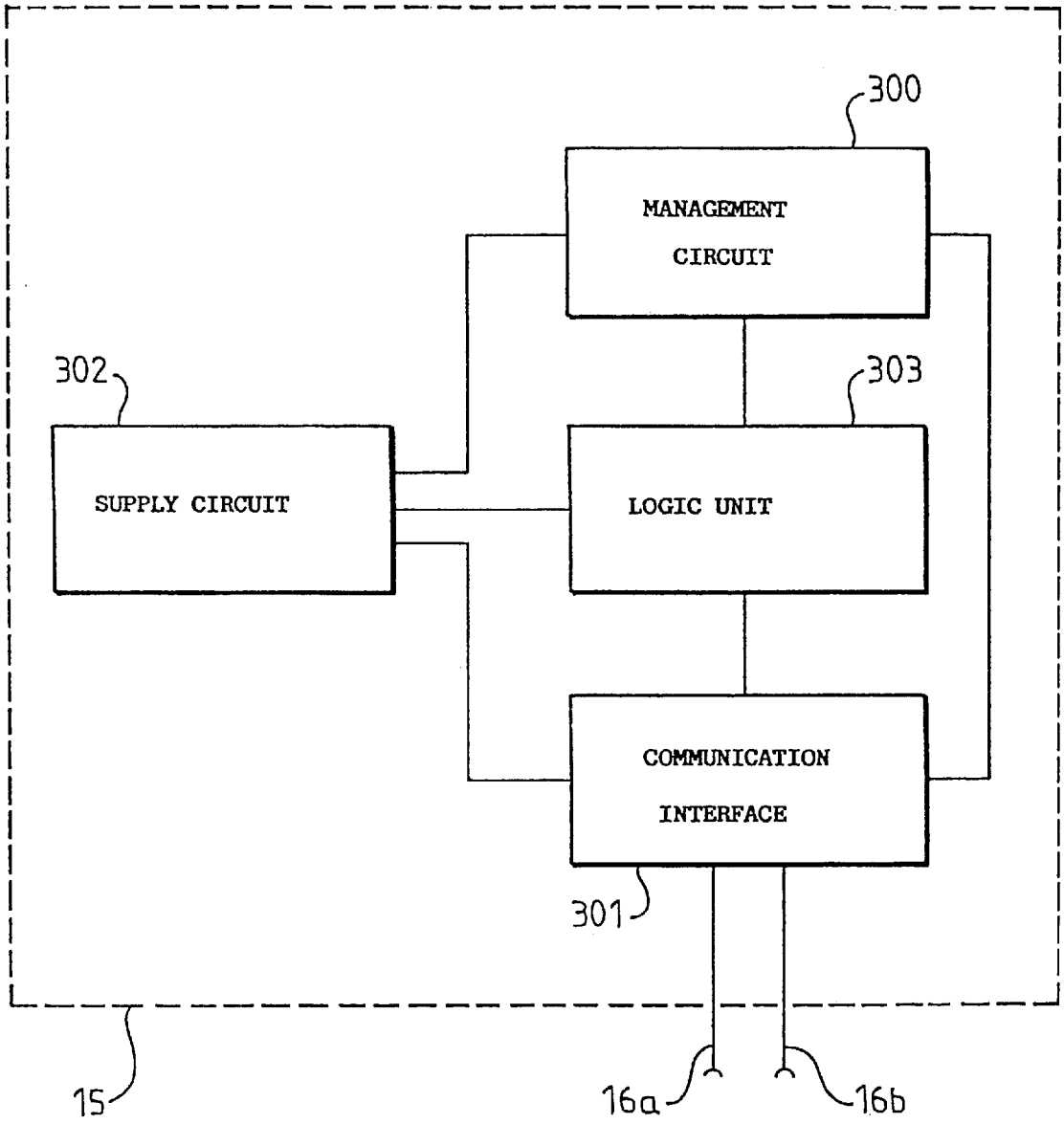
FIG. 3 is an overview of an ignition module according to the invention.

The ignition modules 15 comprise specific integrated circuits, currently denominated ASIC (Application Specific Integrated Circuit). Each ignition module 15 also comprises one or several reservoir capacitors, a power transformer and a Transil. An ignition module 15, such as represented diagrammatically on FIG. 3, comprises four sub-systems: a management circuit 300 of the pyrotechnic burster, a communications interface 301, a power supply circuit 302 and a logic unit 303 for the management of the whole microsystem.

Figure 4:
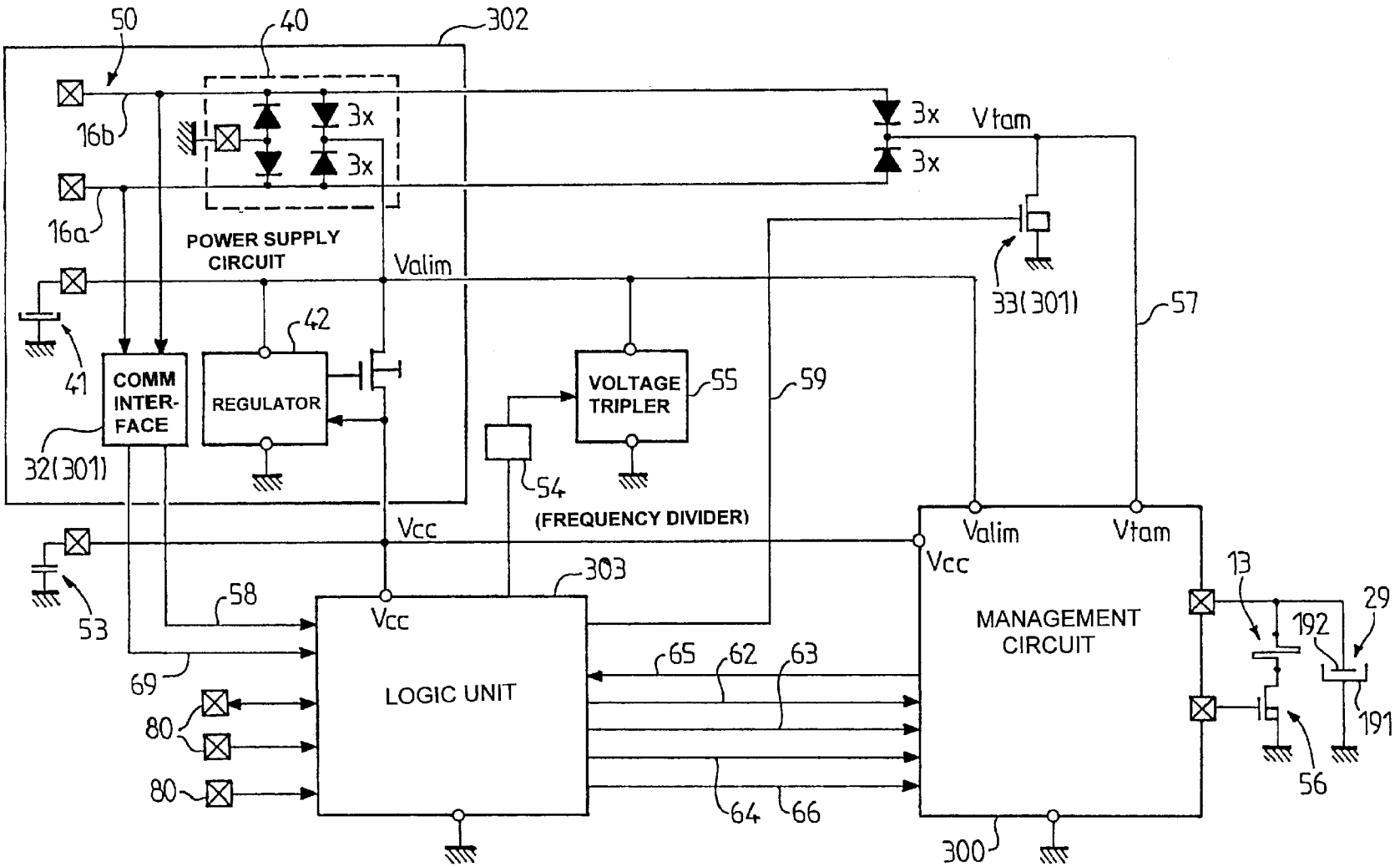
FIG. 4 represents the principle architecture of an ignition module according to the invention.
Figure 5:
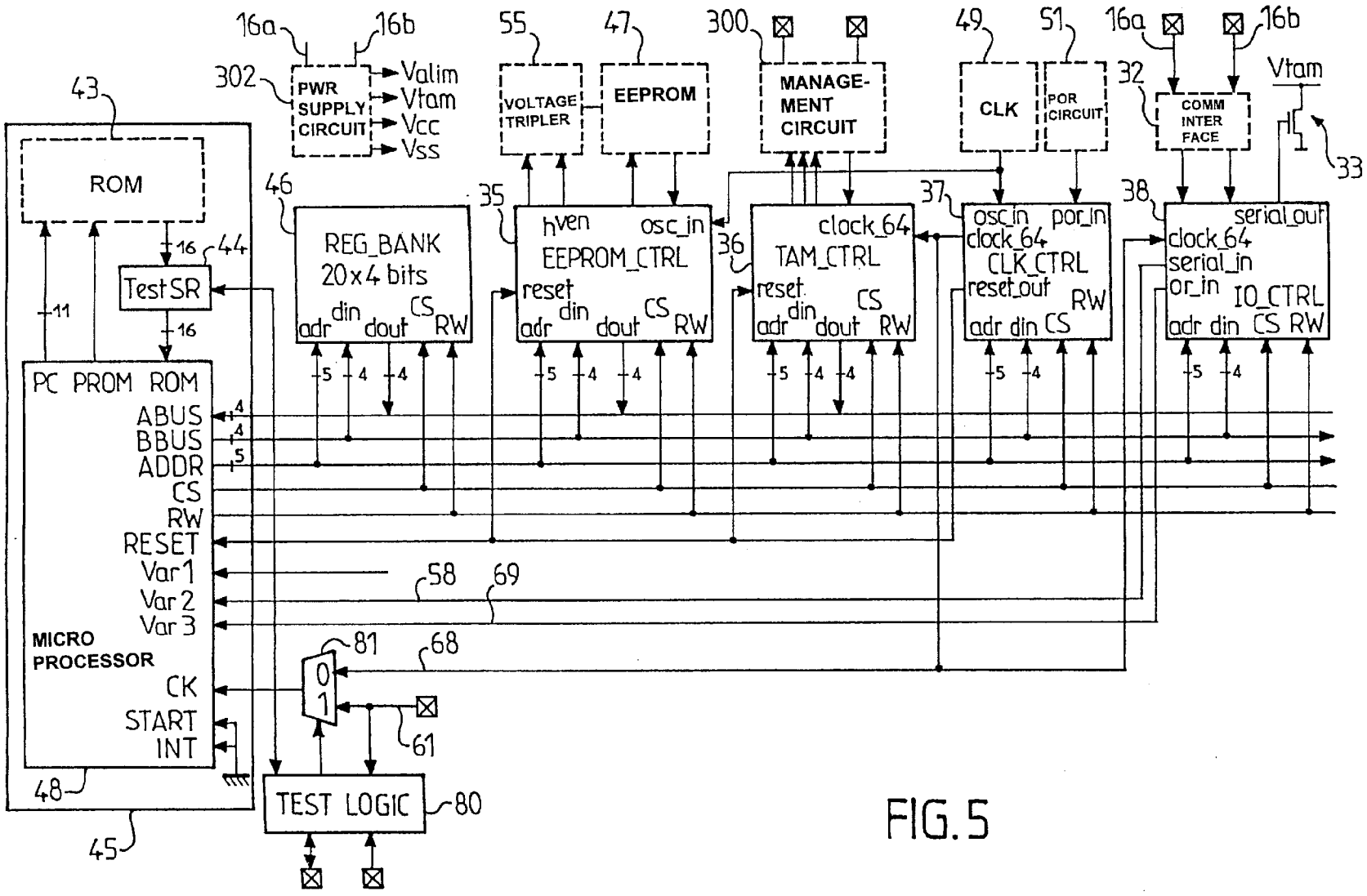
FIG. 5 is a flow chart representation of the ignition module of FIG. 4.
Figure 6:
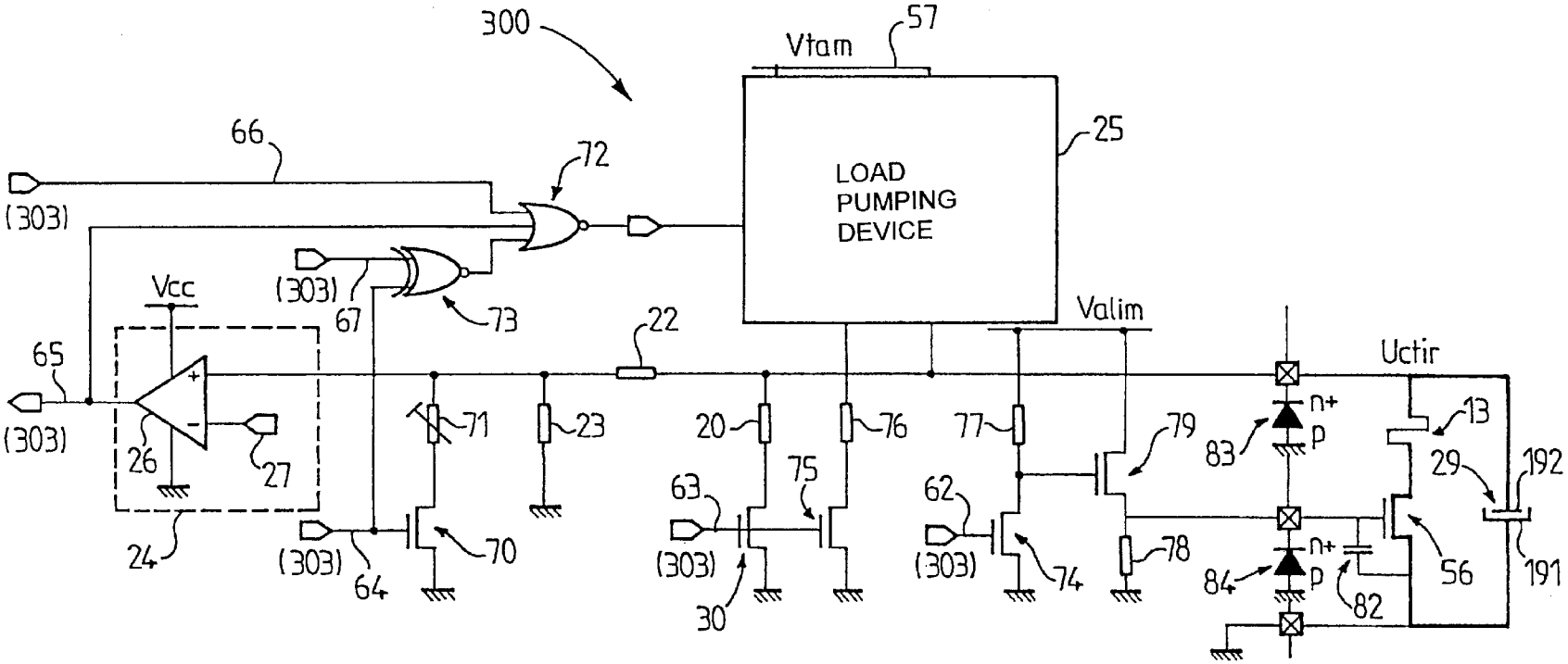
FIG. 6 is a representation of the pyrotechnic burster management circuit of the ignition module of FIG. 4.

Certain features of the signals transmitted over the lines have been mentioned on FIGS. 4 to 6 by reference to those lines.

The power supply 302, as it appears on FIGS. 4 and 5, comprises a diode full wave rectifier bridge 40, which delivers a direct voltage Valim from the direct voltage from the firing line 50.

A logic detection frees the ignition module 15 from any polarisation. The rated Valim voltage ranges between 8 and 15 V.

The power supply circuit 302 also comprises a battery capacitor 41 of 100 $\mu$F with a rated voltage of 16 V, smoothing the direct voltage and constituting an energetic reservoir enabling the whole microsystem to operate for a few seconds when it is not supplied by the firing line 50 any longer.

A regulator 42 has been foreseen to generate a direct operating voltage VDC and equal to 3 V, designed for supplying all the low voltage blocks of the ignition module 15. This regulator 42 is connected to the rectifier bridge 40 from which it receives a supply voltage, as well as to the battery capacitor 41. The regulator 42 comprises a voltage reference and a setting loop comprising an operational amplifier. The voltage reference is of the band-gap voltage type and delivers a 1.20 V regulated reference voltage. The operational amplifier receives the reference voltage by a set input and the supply voltage by a supply input, and then compares a fraction of the supply voltage to the requested 3 V voltage.

The supply circuit 302 comprises an input circuit 32 connected to the logic unit 303 by an input line 58 and a control line 69.

The voltage line VDC is connected to a 100 nF capacitor 53.

The communications interface 301, visible on FIG. 4, comprises the input circuit 32 which plays the part of a receiver sub-assembly, as well as a transmitter sub-assembly 33. The latter comprises essentially a transistor, whose grid is connected to the logic unit 303 by an output line 59, the drain of the management circuit 300 by a cartridge head line 57 and the source is earthed.

The management circuit 300 of the pyrotechnic burster has been represented more especially on FIG. 6. It manages the firing capacitor of the ignition module 15, as well as the control of a DMOS transistor 56, external to the management circuit 300 and serving to trigger off a firing sequence.

The drain of the transistor 56 is connected to the cartridge head 13 and its source is earthed. Its grid is controlled by a firing line 62 from the logic unit 303, via two transistors 74 and 79. The grid of the transistor 74 is connected to the line 62, its source is earthed and its drain is connected to the grid of the transistor 79 as well as to the Valim voltage in parallel, whereby a 4 MΩ resistor 77 is interposed between the drain and the Valim voltage. The drain of the transistor 79, for its own part, is connected to the Valim voltage, its source to the grid of the transistor 56 and to the earth via a 50 kΩ resistor 78.

A diode 84 is arranged from the earth towards the grid of the transistor 56 and a diode 83 from the earth to the pin of the cartridge head 13 other than that connected to the transistor 56.

Moreover, an isolation capacitor 82 can be connected between the grid and the source of the transistor 56.

The management circuit 300 enables to load a 220 $\mu$F firing capacitor 29 to its 16 V rated voltage.

It is supplied by the line of the cartridge head 57 receiving a rectified voltage Vtam from the firing line 50. The voltage Vtam is rated between 11 V and 16 V.

The firing capacitor 29 possesses a first armature 191 directly grounded and its second armature 192 is grounded via a 400 Ω resistor 20 and a MOS transistor 30. The grid of the transistor 30 being controlled by the logic unit 303 using a discharge line 63, the firing capacitor 29 can be discharged rapidly via the resistor 20 when a discharge command is sent to the ignition module 15 or when a supply fault crops up. Typically, this discharge can be performed within 300 ms. The second armature 192 is also connected to the cartridge head 13.

Loading the ignition module 15 is done via a loading line 64 from the logic unit 303. This loading line 64 leads to the grid of a transistor 70 of the management circuit 300 whose source is grounded and whose drain is connected to the second armature 192 of the firing capacitor 29 via a 193 kΩ resistor 71 and a 1700 kΩ resistor 22.

The second armature 192 of the firing capacitor 29 is also grounded via the resistor 22 and a 1700 kΩ resistor 23. Whatever the fault of the whole microsystem, the firing capacitor 29 is always self-discharged during a supply voltage failure, this safety being provided by the resistors 22 and 23.

The management circuit 300 comprises a setting loop 24 consisting of an operational amplifier 26 and of a voltage reference 27. The voltage reference 27, from a PTAT, delivers a 1.20 V regulated reference voltage. The operational amplifier 26 possesses a set input connected to the voltage reference 27 and a supply input connected to the second armature 192 of the firing capacitor 29, via the resistor 22.

The output of the operational amplifier 26 is connected to a comparison line 65 leading to the logic unit 303. It is also connected to the first input of a NOR gate 72, comprising two other inputs. The second input of the NOR gate 72 receives pieces of information from the loading line 64 via a NOR gate 73, whereas this gate possesses a second input connected to a load test line 67. The third input receives clock signals from the logic unit 303 via a load pumping line 66, at a 64 kHz frequency.

The output of the NOR gate 72 leads to a load pumping device 25 calling for, in order to reach full voltage, numerous clock pulses from the logic unit 303 via the line 66.

This device 25 is supplied by the cartridge head line 57 with the Vtam voltage and at two outputs. The first of these outputs is connected to the second armature 192 of the firing capacitor 29, whereas the second is connected to the drain of a transistor 75 by a 50 kΩ resistor 76. The grid of the transistor 75 is controlled by the discharge line 63 and its source is earthed.

During operation, signals are sent at 64 kHz frequency to the NOR gate 72 by the load pumping line 66. In the absence of a loading order, the output of the NOR gate 72 is equal to 0, which implies that the firing capacitor 29 is not supplied by the cartridge head line 57. When a loading order is given via the loading line 64, the output of the NOR gate 72 generates the value 1 at 64 kHz frequency, as long as the output of the operational amplifier 26 does not indicate equality between the rated voltage imposed by the voltage reference 27, and the effective voltage at the pins of the firing capacitor 29. The grid of the transistor 28 is thus actuated and the Vtam voltage sees to loading the firing capacitor 29. Once the rated voltage has been reached, the output of the operational amplifier 26 is equal to 0, so that the output of the NOR gate 72 is equal to 0 and that the supply of the firing capacitor 29 is broken off.

The setting loop 24 thus guarantees the stability of the rated voltage of the firing capacitor 29, whatever the value of the Vtam voltage ranging between 11 V and 16 V.

When a discharge order is sent by the discharge line 63, the grid of the transistor 75 is actuated and the firing capacitor 29 discharges through the discharge circuit.

A test mode has been added to load the firing capacitor 29 to a 2.4 V rated voltage. This mode is entered by enabling a test load variable in the logic unit 303. The processor may then, while testing the output of the operational amplifier 26, check that the loading duration of the firing capacitor 29 remains within the acceptable range.

The logic unit 303 managing each ignition module 15, as detailed on the flow chart of FIG. 5, manages the communications with the firing line 50 as well as the commands of the pyrotechnic burster. It comprises especially an essentially digital control unit 45 or CPU (central processing unit), composed of a four bit microprocessor 48, a ROM memory 43 formed of 2048 16-bit words containing the application program, a test shift register 44 and various peripheral blocks. Each of these peripherals is in relation with one of the analogue blocks of the ignition module 15, whose operation it controls via the software.

The logic unit 303 also comprises a register bank 46, designed for buffering digitised information, and an internal clock 49.

All the non-volatile pieces of information necessary to the operation of the ignition module 15 are stored in an EEPROM memory 47 organised in eight 4-bit words, whereby this EEPROM memory is managed by the control unit 45 using a memory microcontroller 35. The memory 47 is designed especially for receiving the identification parameters of the ignition module 15 in the firing line 50, a setting word of the internal clock 49 of the logic unit 303 and a firing delay.

The microprocessor 48 of the control unit 45 is respectively connected to the management circuit 300, to the internal clock 49 and to the receiver 32 and transmitter 33 subassemblies of the communications interface 301, by microcontrollers 36, 37 and 38.

The internal clock 49 of the logic unit 303 comprises a dual ramp oscillator delivering a 1 Mhz-rated signal, but which can in practice have a frequency ranging from 500 kHz to 2 Mhz, because of technological dispersions. In order to adopt optimal industrial conditions, the oscillator of the internal clock 49 is composed of a simple RC circuit of ASIC technology.

The internal clock 49 also comprises a logic device dividing the frequency generated by the oscillator, by an adjustment coefficient, in order to generate a first output frequency of approx. 64 kHz, ±20%. This first output frequency, which is the local frequency of the internal clock 49, is sent to the control unit 45 by a local frequency line 68. The coefficient is adjusted once and for all during the assembly of the ignition module 15 by a control writing into the EEPROM memory 47 the adjustment coefficient. Temperature fluctuations between 10° C. and +40° C. make this first output frequency shift by max. 10% with respect to a value set at 20° C.

The local frequency line 68 reaches the microprocessor 48 via a frequency comparator 81, whose first input is the line 68, second input is an external clock line 61 and the output is connected to the microprocessor 48. The comparator 81 is designed for allowing calibration of the internal clock 49, whereas the line 61 is connected to the reference time base of the firing console 17.

The internal clock 49 also enables to generate a second output frequency of 500 kHz to work with the EEPROM memory 47, via a frequency divider 54. This second output frequency is designed for being sent to a voltage tripler 55, connected to the power supply circuit 302.

The internal clock 49 also delivers a third 16 kHz output frequency to the management circuit 300.

The tolerances set for the RC values amounting to ±10%, it can be admitted that the local frequencies of the internal clocks of the modules 15 exhibit typically uncertainties in the order of ±20%. This uncertainty range is centred round the desired value, 64 kHz, during factory setting.

However, individual calibration of the internal clocks before a firing sequence with respect to the time base of the firing console 17, enables to remedy these uncertainties.

The logic unit 303 also comprises a POR (Power-in reset) circuit 51, connected to the microprocessor 48 via the microcontroller 37. The POR circuit 51 generates, when switching the ignition module 15 on, an initialisation pulse enabling to generate an initialisation signal of the control unit 45 and of various control variables. This initialisation pulse appears at any rise or drop of the supply voltage, supply voltage which is normally equal to 3 V. Accordingly, the ignition module 15 also produces an initialisation signal when the supply voltage drops below a correct operating threshold. During initialisation, the firing capacitor 29 is discharged automatically. This propriety prevents from any untimely firing in case of accidental power cut.

As regards its relations, represented diagrammatically on FIG. 4, with external elements, the logic unit 303 is connected to the input circuit 32 via the input line 58 and the control line 69.

The connections between the logic unit 303 and the management circuit 300 comprise the firing 62, discharge 63, loading 64, comparison 65 and load pumping 66 lines.

The logic unit is also connected to a set of test pads 80, serving as test points of the circuit during manufacture.

All these links are made with the control unit 45.

During operation, both procedures, manual and automatic, should be distinguished.

During a manual procedure, the operator programmes at the keyboard of the programming console 18 the delay times desired, in milliseconds. These delay times range between 1 and 3000 milliseconds, if not more, and are defined by 1 millisecond increments. The delay times can be chosen freely by the operator and may well be, for instance, identical for two or more modules 15.

Successively, for each of the modules 15, all the following operations are performed. The console 18 is connected to the module 15, as represented on FIG. 2A. The operator enters the corresponding delay time, then validates it by pressing a validation key on the alphanumeric keyboard. The console 18 then sends to the ignition module 15 a programming order.

This programming order can be broken down into two stages: the first stage consists in testing the functionalities of the electronic and pyrotechnic sections of the related detonator 1 whereas the second stage consists in writing effectively the identification parameters into the non-volatile memory of the module 15 as well as specific parameters into EEPROM memories of the programming console 18.

Both identification parameters, firing board number and order number, are determined automatically by the programming console 18 in relation to the current firing board number and to the programming order carried out. Advantageously, the programming console 18 increments automatically the order number after each programming as well as the firing board number after each firing sequence.

As a variation, the operator is entitled to select both identification parameters as he so desires.

The deleting function of the programming console 18 is used if the operator has made a mistake when entering the delay time.

The effective writing of the parameters is subject to whether the test has been passed or not.

Once all the modules 15 used in the firing sequence have been programmed, the programming console 18 is connected to the firing console 17, as represented on FIG. 2B.

Connecting the firing 17 and programming 18 consoles is only authorised after inserting the appropriate magnetic card. Any other safety device can also be used to authorise this connection.

The specific parameters of the modules 15, stored in the programming console 18 are then automatically transferred to the firing console 17 when connection is established between both consoles 17 and 18, by the transfer function provided at the programming console 18. This transfer is performed using the RS 232-type communications interface. The specific parameters are stored in EEPROM memories of the firing console 17.

Once all the specific parameters have been transferred to the firing console 17, the firing line 50 linking the firing console 17 to the detonators 1 is enabled, as shown on FIG. 2C. The firing console 17 thus performs a test of the ignition modules 15 on line. It then waits for the time necessary to carrying out this test order by all the modules 15, before interrogates individually each of the modules 15 by its identification parameters. Each module 15 sends in succession the result of the test in the form of a binary piece of information relating to its operating state: information of the <<module correct>> or <<module incorrect>> type. The said information may be more complicated if needed.

Upon completion of this test by the firing console 17, for each of the modules 15, the local frequency of the internal clock 49 of the module 15 is measured and compared to the reference time basis of the firing console 17. The firing console 17 then calculates an algorithmic correction value that it records into an EEPROM memory of the module 15. The delay time associated with the module 15 is then also sent to this module 15 by the firing console 17. The module 15 derives from it a countdown value allowing to obtain the actual delay time required.

In a variation, the actual delay times are calculated by the firing console 17 and sent directly to the modules 15.

Upon completion of the test and calibration of the modules 15, as well as once the delay times have been recorded, the operator gives a loading order using the appropriate key. The firing capacitors 29 of the ignition modules 15 are then loaded. A message validates this operation.

At any time, the operator is entitled to cancel the fire by giving the order to the ignition modules 15 of unloading their firing capacitors 29, by using the cancel key of the firing console 17.

After loading, the operator can order a firing sequence using the firing key. Depressing this key triggers off the following operations.

First of all, a test should advantageously be carried out so that the modules 15 reply individually to the firing console 17 to confirm whether they are ready for firing or not.

Upon completion of this validation, the firing line 50 can be cut off, whereas the standalone battery of each module 15, in the form of the battery capacitor 41, is switched on.

The logic unit 303 can then command advantageously the resetting of the internal clock 49, which brings the latter back to its state previously calibrated by the firing console 17 using the reference time basis. Immediately after, it triggers off the countdown of the corrected delay time, to determine the exact moment of firing. The firing sequence is then switched on for all the modules 15.

Purely for illustrative purposes, for 200 modules 15, the test phases, calibration and programming last approximately ten minutes and the loading of the firing capacitors 29, approximately 5 minutes. A firing sequence is for instance triggered off half an hour after programming the modules 15, whereas this firing sequence is spread over some ten seconds.

The rudimentary internal clocks 49 are perfectly suited to these operations, even without resetting. Indeed, the ASIC circuits benefit from a good thermal protection, which makes them little sensitive to the 30 minutes elapsed between the programming phase and the firing sequence. The local frequencies of the internal clocks thus exhibit the propriety of being stable with the passing of time.

In the optional embodiment with resetting, the internal clocks 49 are, moreover, brought back to their calibrated states. The oscillators used are then very stable during the ten seconds or so, max., between resetting and firing.

With the automatic procedure, the operator does not programme the delay times, but contents itself to depress the validation key of the programming console 18. For each module 15, the programming console 18 performs a test of the module 15, then stores into the memory of the latter, its identification parameters should the information pass the test, as in the manual procedure.

The automatic procedure differs from the manual procedure in that the specific parameters of the modules 15 are transferred to the firing console 17, not by the programming console 18, but by the information storage medium, internal or external to the firing console 17. This information storage medium may typically be a floppy or a tape, providing the firing console 17 is fitted with the corresponding drive. It may also consist of a memory internal to the firing console 17. The rest of the automatic procedure is identical to the manual one.

As a variation, in manual or automatic procedure, the firing console 17 is capable of detecting the presence on the firing line 50 of any ignition module 15 which has not been programmed by the programming console 18. According to another variation, the firing console 17 is capable of processing information coming simultaneously from several programming consoles 18.

Numerous safety procedures have been provided. Access to the firing 17 and programming 18 consoles sets forth that the operator be in possession of recognition codes. The consoles 17 and 18 as well as the modules 15 can be customised before leaving the factory.

Advantageously, the firing console 17 can only perform a firing sequence if it is connected physically, at the time of firing, to the programming console(s) 18 used to programme the ignition modules 15 affected by the said firing sequence. This measure increases the safety of the device.

Thus, recognition can be provided between the firing 17 and programming 18 consoles. In case of flight, especially, an operator has the possibility of using a firing console 17 in order to fire the modules 15 only if the said firing console 17 corresponds to the programming console 18 which has been used to programme the modules 15. Recognition by an internal code of the programming console 18 by the firing console 17 has been provided to this end. If the code is not recognised, the firing console 17 does not record the information pertaining to the delay times stored in the memory of the programming console 18 and the fire is blocked.

It should also be noted that, although the firing assembly has been designed for on-site programming, factory programming is also possible.

What is claimed is:

1. A method of controlling detonators (1) fitted with an electronic ignition module (15), whereas each ignition module (15) is associated with specific parameters comprising at least one identification parameter and one explosion delay time of the related detonator (1), whereas the said ignition module (15) comprises the following elements:

a firing capacitor (29) designed, after loading, to discharge in a cartridge head (13) of the said detonator (1) to generate an ignition, a battery capacitor (41) ensuring temporary operating autonomy, a rudimentary internal clock (49) with a local frequency, a non-volatile identification memory (47) designed for the storage of the identification parameters, whereby the said modules (15) are capable of establishing a dialogue with a firing control unit (17) fitted with a reference time basis, and designed for transmitting, notably, to them an order to load their firing capacitors (29), as well as an order to fire and to receive from the said modules (15) one or several pieces of information relevant to their states, in which:

the specific parameters are stored in at least one information storage medium, at least one programming unit (18) is caused to enter the identification parameters, using the programming unit (18), the identification parameters are stored in the modules (15), the specific parameters are stored using the information storage medium in the firing control unit (17), the modules (15) are ordered using the firing control unit (17), to load the firing capacitors (29), a firing order is sent to the modules (15) using the firing control unit (17), triggering off a firing sequence synchronised to the local frequencies wherein, after storing the specific parameters in the firing control unit (17) and before loading the firing capacitors (29), the local frequency of the internal clock (49) of the said module (15) is measured, using the firing control unit (17) and for each successive module (15), using the reference time basis, then this internal clock (49) is calibrated taking this measurement into account, using an algorithmic correction value of the said local frequency and finally, an associated delay time is sent to the said module (15), wherein after the firing order, the internal clocks (49) of all the modules (15) are reset.

2. A control method according to claim 1, wherein the information storage medium is distinct from the programming unit (18).

3. A control method according to claim 1, wherein after storing the specific parameters in the firing control unit (17) and before measuring the local frequencies, the said modules (15) are tested using the firing control unit (17) while asking simultaneously at least one piece of information from them and while addressing each module (15) individually by its identification parameters in order to collect the said piece of information.

4. A method of controlling detonators (1) fitted with an electronic ignition module (15), whereas each ignition module (15) is associated with specific parameters comprising at least one identification parameter and one explosion delay time of the related detonator (1), whereas the said ignition module (15) comprises the following elements:

a firing capacitor (29) designed, after loading, to discharge in a cartridge head (13) of the said detonator (1) to generate an ignition, a battery capacitor (41) ensuring temporary operating autonomy, a rudimentary internal clock (49) with a local frequency.

a non-volatile identification memory (47) designed for the storage of the identification parameters, whereby the said modules (15) are capable of establishing a dialogue with a firing control unit (17) fitted with a reference time basis, and designed for transmitting, notably, to them an order to load their firing capacitors (29), as well as an order to fire and to receive from the said modules (15) one or several pieces of information relevant to their states, in which:

the specific parameters are stored in at least one information storage medium, at least one programming unit (18) is caused to enter the identification parameters, using the programming unit (18), the identification parameters are stored in the modules (15), the specific parameters are stored using the information storage medium in the firing control unit (17), the modules (15) are ordered using the firing control unit (17), to load the firing capacitors (29), a firing order is sent to the modules (15) using the firing control unit (17), triggering off a firing sequence synchronised to the local frequencies wherein, after storing the specific parameters in the firing control unit (17) and before loading the firing capacitors (29), the local frequency of the internal clock (49) of the said module (15) is measured, using the firing control unit (17) and for each successive module (15), using the reference time basis, then this internal clock (49) is calibrated taking this measurement into account, using an algorithmic correction value of the said local frequency and finally, an associated delay time is sent to the said module (15), wherein during calibration of the internal clock (49) of each module (15), a corrected delay time is calculated with the firing control unit (17), whereas the said delay time is sent to the said module (15).

5. A method of controlling detonators (1) fitted with an electronic ignition module (15), whereas each ignition module (15) is associated with specific parameters comprising at least one identification parameter and one explosion delay time of the related detonator (1), whereas the said ignition module (15) comprises the following elements:

a firing capacitor (29) designed, after loading, to discharge in a cartridge head (13) of the said detonator (1) to generate an ignition, a battery capacitor (41) ensuring temporary operating autonomy, a rudimentary internal clock (49) with a local frequency, a non-volatile identification memory (47) designed for the storage of the identification parameters, whereby the said modules (15) are capable of establishing a dialogue with a firing control unit (17) fitted with a reference time basis, and designed for transmitting, notably, to them an order to load their firing capacitors (29), as well as an order to fire and to receive from the said modules (15) one or several pieces of information relevant to their states, in which:

the specific parameters are stored in at least one information storage medium, at least one programming unit (18) is caused to enter the identification parameters, using the programming unit (18), the identification parameters are stored in the modules (15), the specific parameters are stored using the information storage medium in the firing control unit (17), the modules (15) are ordered using the firing control unit (17), to load the firing capacitors (29), a firing order is sent to the modules (15) using the firing control unit (17), triggering off a firing sequence synchronised to the local frequencies wherein, after storing the specific parameters in the firing control unit (17) and before loading the firing capacitors (29), the local frequency of the internal clock (49) of the said module (15) is measured, using the firing control unit (17) and for each successive module (15), using the reference time basis, then this internal clock (49) is calibrated taking this measurement into account, using an algorithmic correction value of the said local frequency and finally, an associated delay time is sent to the said module (15), wherein each module (15) comprising a processing unit (303), when calibrating the internal clock (49) of the module, the algorithmic correction value of the local frequency of its internal clock (49) is sent to the said module (15) using the firing control unit (17), then a corrected delay time is calculated using the processing unit (303) of the said module (15).

6. A method of controlling detonators (1) fitted with an electronic ignition module (15), whereas each ignition module (15) is associated with specific parameters comprising at least one identification parameter and one explosion delay time of the related detonator (1), whereas the said ignition module (15) comprises the following elements:

a firing capacitor (29) designed, after loading, to discharge in a cartridge head (13) of the said detonator (1) to generate an ignition, a battery capacitor (41) ensuring temporary operating autonomy, a rudimentary internal clock (49) with a local frequency, a non-volatile identification memory (47) designed for the storage of the identification parameters, whereby the said modules (15) are capable of establishing a dialogue with a firing control unit (17) fitted with a reference time basis, and designed for transmitting, notably, to them an order to load their firing capacitors (29), as well as an order to fire and to receive from the said modules (15) one or several pieces of information relevant to their states, in which:

the specific parameters are stored in at least one information storage medium, at least one programming unit (18) is caused to enter the identification parameters, using the programming unit (18), the identification parameters are stored in the modules (15), the specific parameters are stored using the information storage medium in the firing control unit (17), the modules (15) are ordered using the firing control unit (17), to load the firing capacitors (29), a firing order is sent to the modules (15) using the firing control unit (17), triggering off a firing sequence synchronised to the local frequencies wherein, after storing the specific parameters in the firing control unit (17) and before loading the firing capacitors (29), the local frequency of the internal clock (49) of the said module (15) is measured, using the firing control unit (17) and for each successive module (15), using the reference time basis, then this internal clock (49) is calibrated taking this measurement into account, using an algorithmic correction value of the said local frequency and finally, an associated delay time is sent to the said module (15), wherein before storing the identification parameters in each module (15), the electronic and pyrotechnic functionalities of the related detonator (1) are tested using the programming unit (18).

7. An encoded firing control assembly comprising detonators (1) fitted with an electronic ignition module (15), whereas each ignition module (15) is associated with specific parameters comprising at least one identification parameter and one explosion delay time of the related detonator (1) during a firing sequence, whereas the said ignition module (15) comprises the following elements:

a firing capacitor (29) designed, after loading, to discharge in a cartridge head (13) of the said detonator (1) to generate an ignition, a battery capacitor (41) ensuring temporary operating autonomy, a rudimentary internal clock (49) with a local frequency, a non-volatile identification memory (47) designed for the storage of the said identification parameters, whereas the encoded assembly also contains:

a programming unit (18) capable of inputting the specific parameters of the modules (15) and of storing the identification parameters in the corresponding modules (15), a firing control unit (17) fitted with a reference time base and with a memory capable of receiving the specific parameters of the modules (15), whereas the said firing control unit (17) can be linked electrically on line to the said modules (15) and to establish a dialogue with them, especially by sending to the said modules (15) having received their identification parameters from the programming unit (18), the associated delay times, while measuring the local frequencies of their internal clocks (49) using the reference delay time, by calibrating the said internal clocks (49) and by sending to the said modules (15) a firing order triggering off a firing sequence, wherein the firing control unit (17) and the modules (15) comprise calibration means enabling to calibrate the internal clocks (49) in relation to the reference time basis after storing specific parameters in the firing control unit, wherein the modules (15) comprise means for resetting their internal clocks (49) further to a firing order sent by the firing control unit (17).

8. An encoded firing control assembly according to claim 7, characterised in that the modules (15) comprise means for resetting their internal clocks (49) further to a firing order sent by the firing control unit (17).

9. An encoded firing control assembly according to claim 7, wherein, the said assembly comprising an electric link between each module (15) and the cartridge head (13) of the associated detonator (1), and the said module (15) being capable of sending to the said cartridge head (13), via the said electric link, a current generating a firing sequence, the cartridge heads (13) possess conducting or semiconducting bridges.

10. An ignition module (15) of a detonator (1) fitted with a pyrotechnic burster comprising a power supply circuit (302) containing notably a battery capacitor (41) ensuring temporary operating autonomy, a communications interface (301), a pyrotechnic burster management circuit (300) comprising, notably a firing capacitor (29) designed for, after loading, discharging into a cartridge head (13) of the detonator (1), as well as a logic unit (303) of the management of the module assembly (15), whereby the said logic unit (303) comprises a non-volatile identification memory (47) designed for receiving at least one identification parameter of the said module (15) and a rudimentary internal clock (49) with a local frequency, wherein the module (15) contains a calibration memory enabling to receive a calibration value of the internal clock (49) in relation to a reference time basis, originating from a firing control unit (17) capable of sending to the module (15), a firing order, and further comprising means for resetting the internal clock (49) to a calibrated state and the logic unit (303) comprises a resetting control actuating the resetting means during a firing order.

11. An ignition module (15) of a detonator (1) fitted with a pyrotechnic burster comprising a power supply circuit (302) containing notably a battery capacitor (41) ensuring temporary operating autonomy, a communications interface (301), a pyrotechnic burster management circuit (300) comprising, notably a firing capacitor (29) designed for, after loading, discharging into a cartridge head (13) of the detonator (1), as well as a logic unit (303) of the management of the module assembly (15), whereby the said logic unit (303) comprises a non-volatile identification memory (47) designed for receiving at least one identification parameter of the said module (15) and a rudimentary internal clock (49) with a local frequency, wherein the module (15) contains a calibration memory enabling to receive a calibration value of the internal clock (49) in relation to a reference time basis, originating from a firing control unit (17) capable of sending to the module (15), a firing order said ignition module, and further comprising a customised ASIC-type integrated circuit, the firing capacitor (29), the battery capacitor (41), a power transformer (56) and a protective device against electrostatic discharges.

* * * * *